US007747033B2

(12) United States Patent
Uchimura

(10) Patent No.: US 7,747,033 B2
(45) Date of Patent: Jun. 29, 2010

(54) ACOUSTIC TUBE AND DIRECTIONAL MICROPHONE

(75) Inventor: Satoshi Uchimura, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 1118 days.

(21) Appl. No.: 11/385,655

(22) Filed: Mar. 22, 2006

(65) Prior Publication Data

US 2006/0222196 A1 Oct. 5, 2006

(30) Foreign Application Priority Data

Apr. 1, 2005 (JP) ..... 2005-106003

(51) Int. Cl.
*H04R 9/08* (2006.01)
*H04R 31/00* (2006.01)

(52) U.S. Cl. ..... 381/356; 29/594; 381/358

(58) Field of Classification Search ..... 381/355, 381/356, 358, 360; 29/594
See application file for complete search history.

(56) References Cited

U.S. PATENT DOCUMENTS 3,993,161 A * 11/1976 Shore ..... 181/135
4,862,507 A * 8/1989 Woodard ..... 381/360

FOREIGN PATENT DOCUMENTS

| | | |
|---|---|---|
| JP | 57-181176 | 11/1982 |
| JP | 6-48294 | 6/1994 |
| JP | 8-317487 | 11/1996 |
| JP | 11-168783 | 6/1999 |
| JP | 2000-50385 | 2/2000 |
| JP | 2000-83292 | 3/2000 |
| JP | 2000-333283 | 11/2000 |

* cited by examiner

*Primary Examiner*—Brian Ensey
(74) *Attorney, Agent, or Firm*—Oblon, Spivak, McClelland, Maier & Neustadt, L.L.P.

(57) ABSTRACT

An acoustic tube that can be manufactured simply and can also be reduced in size easily is obtained. By using the acoustic tube, a directional microphone which has a simple structure and can be reduced in size easily is obtained. In an integrally molded acoustic tube, an acoustic resistance material arranged on the inner circumferential surface of the acoustic tube is integrated to the acoustic tube by molding of the acoustic tube. It is preferable to select resin as the material of the acoustic tube and resin mesh as that of the acoustic resistance material. It is preferable that the acoustic tube have a slit-like acoustic resistance part and the acoustic resistance material be present in the acoustic resistance part. It is preferable to configure a directional microphone by using the acoustic tube.

3 Claims, 2 Drawing Sheets

ACOUSTIC TUBE AND DIRECTIONAL MICROPHONE

BACKGROUND OF THE INVENTION

1. Field of the Invention

The present invention relates to an acoustic tube that can be used in, for example, a microphone, and a directional microphone using the same, and more particularly to an acoustic tube and a directional microphone, the manufacturing process of which can be simplified and the size of which can be reduced.

2. Related Background of the Invention

For example, a microphone with narrow directivity is configured so that sound waves at angles other than that of the main sound collection axis enter into an acoustic tube through a front surface of the acoustic tube and an acoustic resistance part on the side thereof by arranging the acoustic tube with leakage at a front acoustic terminal of a microphone unit. The sound waves that have entered through the front surface of the acoustic tube and the sound waves that have entered through the acoustic resistance part attenuate due to a difference between both phases and the sound waves along the main sound collection axis are emphasized, and thereby a narrow directivity is obtained.

As an example of a specific configuration of the acoustic tube, there is one having a plurality of through holes for acoustic resistance on a circumferential surface and provided with an acoustic resistance material composed of felt, resin mesh, nonwoven fabric, etc. on the outer circumferential surface of the acoustic tube. The acoustic tube is known which further has an outer case engaged with the outer circumferential surface thereof, the inner diameter of which is greater than the outer diameter of the acoustic resistance and in the circumferential surface of which a plurality of through holes are formed, and has a microphone unit disposed in the acoustic tube (for example, refer to the patent document 1).

However, for the configuration of the acoustic tube described in the document patent 1, it is necessary to further engage an outer case with the outer circumferential surface side because the acoustic resistance material composed of unwoven fabric etc. is provided on the outer circumferential surface of the acoustic tube, thus the structure becomes complex and the manufacturing process becomes intricate. Therefore, there is known a narrow directional microphone that has obviated the need for the outer case by providing the acoustic resistance material on the inner circumferential surface side of the acoustic tube (for example, refer to the patent document 2).

FIG. 2 shows a conventional example of an acoustic tube based on the same idea as that of the acoustic tube described in the patent document 2. In FIG. 2, on the circumferential wall of an elongated, cylindrical acoustic tube 1 made of metal, a plurality of slits 2 constituting an acoustic resistance part in the direction parallel to the center axis line of the acoustic tube are formed in such a manner as to be arranged aligned in the direction of the center axis line, penetrating through the circumferential wall of the acoustic tube 1. There is a case where only one row of the slits 2 is formed or a case where two or more rows, for example, two rows in total are formed, each row being formed on the respective positions of the circumferential wall in opposition to each other. An acoustic resistance material 3 is bonded to the inner circumferential surface of the acoustic tube 1. The acoustic resistance material 3 is made of, for example, resin mesh and by bonding, for example, by using a double-sided adhesive tape, is bonded to the inner circumferential surface of the acoustic tube 1. The right-hand side of the acoustic tube 1 in FIG. 2 is the proximal end and the left-hand side is the front end and to the proximal end portion, a microphone unit, not shown, is attached. The front end side is fitted with a front damper 4 and its outside is fitted with a grill mesh 5 and its further outside is fitted with a grill 6.

[Patent document 1] Japanese Utility Model Application Laid-Open No. Hei 6-48294

[Patent document 2] Japanese Patent Application Laid-Open No. 2000-83292

SUMMARY OF THE INVENTION

According to the conventional acoustic tube as shown in FIG. 2, because of the configuration in which the acoustic resistance material 3 is bonded to the inner circumferential surface of the acoustic tube 1 by bonding, there is a drawback that its manufacturing process is troublesome. In particular, it is necessary for the acoustic resistance material 3 to be bonded to the inner circumferential surface of the acoustic tube 1 with no space left therebetween, therefore, care must be taken in bonding work and the work requires a skill because it is difficult to bond at a predetermined position with precision. In conjunction with such a problem, it is also difficult to reduce an acoustic tube in size. If an acoustic tube is reduced in size, the bonding work itself of an acoustic resistance material becomes more difficult and it becomes more difficult to bond at a predetermined position with precision.

The present invention has been developed in order to solve the problems about the conventional technique described above and an object thereof is to provide an acoustic tube that can be manufactured simply and reduced in size easily and a directional microphone which has a simple structure and can be easily reduced in size by employing such an acoustic tube.

The present invention is an integrally molded acoustic tube and most mainly characterized in that an acoustic resistance material arranged on the inner circumferential surface of the acoustic tube is integrated to the acoustic tube by the molding of the acoustic tube.

It is preferable that the material of the acoustic tube be resin and the acoustic resistance material be resin mesh.

It is preferable that the acoustic tube have a slit-like acoustic resistance part and the acoustic resistance material be present in the acoustic resistance part.

It is preferable to configure a directional microphone by using the acoustic tube.

Since it is possible to obtain an acoustic tube on the inner circumferential surface of which an acoustic resistance material is arranged by integral molding, manufacture of the acoustic tube becomes extremely simple and manufacture does not require a skill. Further, by integrally molding the acoustic tube with setting the position of the acoustic resistance material in a molding die in advance, the relative position precision of the acoustic resistance material with respect to the acoustic tube can be increased and therefore it is possible to obtain an acoustic tube with high precision even if the outer diameter of the acoustic tube is reduced.

According to the directional microphone using the acoustic tube of the present invention, it is possible to obtain a directional microphone with high precision and reduced in size at a low cost.

DESCRIPTION OF THE PREFERRED EMBODIMENTS

An embodiment of an acoustic tube and a directional microphone according to the present invention is explained below with reference to drawings.

Figure 1:
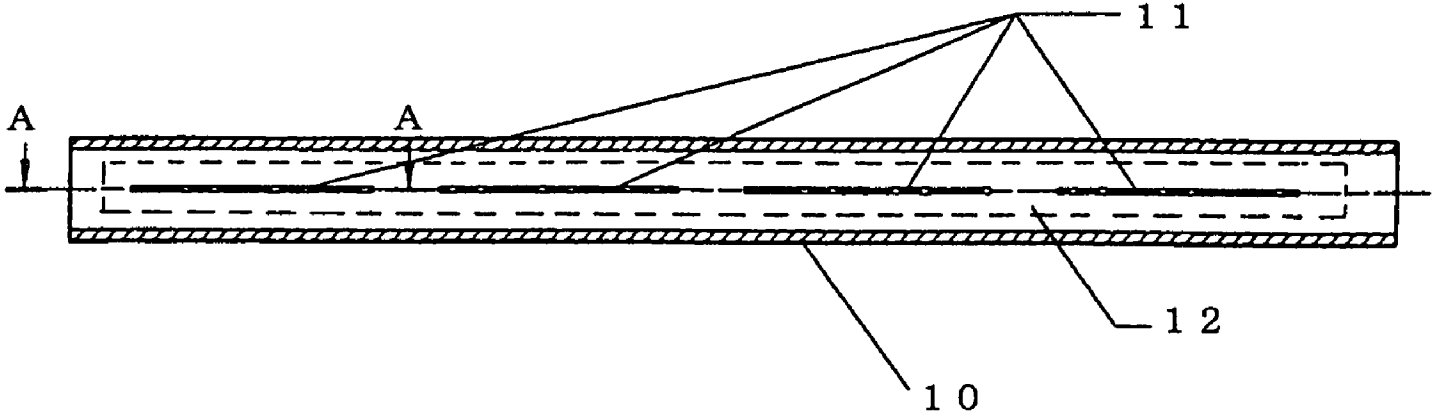
FIGS. 1(*a*) and 1(*b*) show an embodiment of an acoustic tube according to the present invention, wherein FIG. 1(*a*) is a longitudinal section view and FIG. 1(*b*) is an enlarged view of the section along the line A-A in FIG. 1(*a*).
Figure 1:
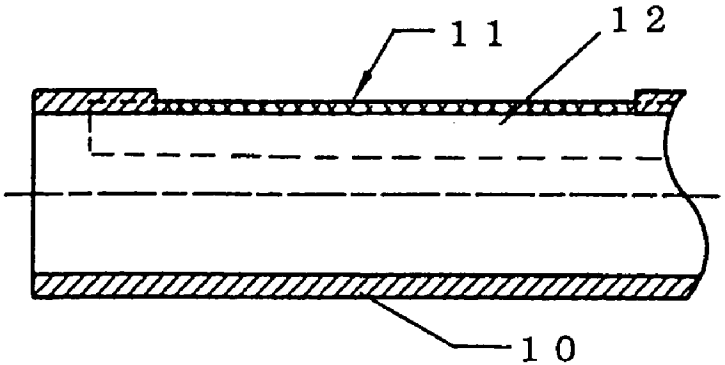
Figure 2:
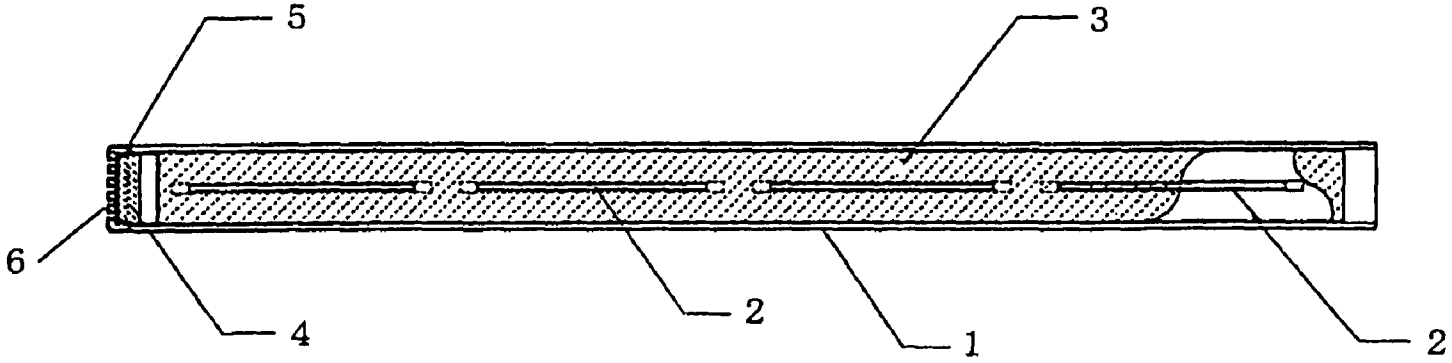
Fig. 2 (RELATED ART)
FIG. 2 is a longitudinal section view showing an example of a conventional acoustic tube.

In FIGS. 1(*a*) and 1(*b*), a reference numeral 10 denotes an acoustic tube. The acoustic tube 10 is an integrally molded product made of resin and on the circumferential wall of the elongated and cylindrical acoustic tube 10, a plurality of slits 11 constituting an acoustic resistance part in the direction parallel to the center axis line of the acoustic tube 10 are formed at constant intervals aligned in the direction of the center axis line. The slit 11 formed so as to penetrate through the wall surface of the acoustic tube 10 and through the slit 11, the inside and the outside of the acoustic tube 10 are communicated with each other. In the embodiment shown schematically, only one row of the slits 11 is formed, however, two or more rows, for example, two rows in total may be formed, each being formed on the respective wall surfaces in opposition to each other. On the inner circumferential surface side of the acoustic tube 10, an acoustic resistance material 12 is arranged integrated to the acoustic tube 10. The acoustic resistance material 12 is made of resin mesh and fused with the acoustic tube 10, which is an integrally molded product made of resin. The acoustic resistance material 12 is originally an elongated and band-like material and after the acoustic tube 10 is molded, overlapped on the slit 11 constituting the row. Therefore, after molding, it is possible to see the acoustic resistance material 12 from the outside of the acoustic tube 10 through the slit 11. It may also be possible to use the plural acoustic resistance materials 12 corresponding to the number of rows of the slits 11 and arrange the respective materials 12 so as to overlap the respective slits 11, or it may be possible to configure such that the inner circumferential surface of the acoustic tube 10 is covered with the acoustic resistance material 12 by arranging one sheet of acoustic resistance material 12 so as to have a cylindrical shape on the inner circumferential surface of the acoustic tube 10.

The acoustic resistance material 12 is not necessarily made of resin mesh. For example, it may be made of metal mesh, nonwoven fabric, or other fabric. Further, the material of the acoustic tube 10 is not limited to resin. Any material will do as long as it can be molded by a molding die and, for example, aluminium die-cast or a sintered body of metal powder will do.

If one end portion of the acoustic tube 10 integrally molded with the acoustic resistance material 12 is caused to have a role as a proximal end portion and the other end portion to have a role as a front end portion, it is possible to configure a narrow directional microphone by arranging, for example, a condenser microphone unit at the proximal end portion. In other words, it is possible to obtain a narrow directional microphone by introducing the sound waves around the main sound collection axis through the front end of the acoustic tube 10 and attenuating the sound waves at angles other than that of the main sound collection axis by means of the phase difference, as described above, between the sound waves having entered through the front surface of the acoustic tube 10 and the sound waves having entered through the slit 11 and the acoustic resistance material 12 as the acoustic resistance part.

Next, a manufacturing method of the acoustic tube 10 is explained with a case of resin molding as an example. The acoustic tube 10 is manufactured by integral molding using a molding die. The molding die consists of a cylindrical slide die for molding the inner circumferential surface of the acoustic tube 10 and a two-piece die for molding the outer circumferential surface of the acoustic tube 10. At least one of the two-piece die is integrally provided with a protrusion for molding the slit 11 and the protrusion protrudes in the direction in which the die is removed from a molding. The acoustic resistance material 12 is positioned and arranged on the outer circumferential surface of the slide die and next, the slide die is sandwiched by the two-piece die. At this time, the acoustic resistance material 12 is pressed against the slide die with the protrusion formed on at least one of the two-piece die. In this state, resin, which is a molding material, is injected into a molding cavity formed between the slide die and the two-piece die and having the same cavity shape as that of the acoustic tube 10 to be molded.

As described above, the acoustic tube 10 is integrally molded in the form in which the acoustic resistance material 12 molded with the acoustic tube 10 by so-called insert molding. After injection molding, by splitting the two-piece die and sliding the slide die to remove from the molding, it is possible to obtain the acoustic tube 10 integrated with the acoustic resistance material 12 as described above. By means of the plurality of protrusions formed on at least one of the two-piece die, the plurality of slits 11 are formed as the acoustic resistance part shown in FIG. 1 and the acoustic resistance material 12 is integrated on the inner circumferential surface side of the acoustic tube 10 in such a manner as to overlap each slit 11. If the protrusions for molding the slits 11 are provided on both of the two-piece die, two rows of the slits 11 are formed as a result. In this case, it may also be possible to prepare two sheets of the acoustic resistance materials 12 and arrange them corresponding to two rows of the slits 11 for molding, a sheet of the acoustic resistance material is made into a cylindrical shape for molding.

According to the embodiment explained above, it is possible to obtain the acoustic tube 10 in which the acoustic resistance material 12 is arranged on the inner circumferential surface where the slits 11 are present by integral molding, therefore, the manufacture of the acoustic tube 10 is made extremely easy without skill and it is also easy to obtain an acoustic tube with a small diameter. Further, by integrally molding the acoustic tube 10 with the position of the acoustic resistance material 12 set in advance in the molding die, it is possible to increase the relative position precision of the acoustic resistance material 12 with respect to the acoustic tube 10 and an acoustic tube with high precision can be obtained even if the outer diameter of the acoustic tube is reduced.

Note that it is preferable for the acoustic resistance material 12 to be metal mesh when an acoustic tube is manufactured using aluminium die-cast or a sintered body of metal powder.

The main use of the acoustic tube according to the present invention is in a directional microphone, however, it is also applicable to other acoustic devices.

EXPLANATIONS OF LETTERS OR NUMERALS

10 acoustic tube

11 slit as acoustic resistance part

12 acoustic resistance material

What is claimed is:

1. An acoustic tube comprising:

a molded elongated cylindrical shaped resin acoustic tube part having a slit shaped acoustic resistance part extending through the wall of the acoustic tube part to communicate the inside and outside of the acoustic tube part; and an acoustic resistance material comprising a resin mesh and arranged on an inner circumferential surface of the acoustic tube part so as to overlap with the acoustic resistance part, wherein the acoustic resistance material is fused to, and integrated with, the acoustic tube part by integrally molding the acoustic resistance material with the acoustic tube part.

2. A directional microphone comprising:

a molded elongated cylindrical shaped resin acoustic tube having a slit shaped acoustic resistance part extending through the wall of the acoustic tube to communicate the inside and outside of the acoustic tube;

an acoustic resistance material comprising a resin mesh and arranged on an inner circumferential surface of the acoustic tube so as to overlap with the acoustic resistance part, wherein the acoustic resistance material is fused to, and integrated with, the acoustic part by integrally molding the acoustic resistance material with the acoustic tube part; and a microphone unit disposed in the acoustic tube.

3. A method of manufacturing a resin acoustic tube using a molding die comprising a cylindrical slide die for molding the inner circumferential surface of the acoustic tube and a two-piece die for molding the outer circumferential surface of the acoustic tube, wherein a protrusion for forming a slit is formed on at least one piece of the two-piece die, the protrusion protruding in the direction in which the cylindrical slide die is removed from a molding, the manufacturing method comprising:

a step of positioning and arranging the acoustic resistance material on the outer circumferential surface of the cylindrical slide die for molding the inner circumferential surface of the acoustic tube, a step of sandwiching the cylindrical slide die by the two-piece die and pressing the acoustic resistance material against the cylindrical slide die with the protrusion formed on at least one piece of the two-piece die, a step of molding the acoustic tube integrally with the acoustic resistance material by injecting resin into a molding cavity formed between the cylindrical slide die and the two-piece die, and a step of removing the cylindrical slide die by splitting the two-piece die and sliding the cylindrical slide die from the molding after the injection molding step.

* * * * *